United States Patent [19]

Norris et al.

[11] 4,075,745

[45] Feb. 28, 1978

[54] APPARATUS FOR MANUFACTURING FILAMENTS OF VARYING DENIER

[75] Inventors: Alan H. Norris; Phillip W. Chambley, both of Rome, Ga.

[73] Assignee: Champion International Corporation, Stamford, Conn.

[21] Appl. No.: 771,954

[22] Filed: Feb. 25, 1977

[51] Int. Cl.[2] ..... D02J 1/22

[52] U.S. Cl. ..... 28/243; 57/38.3; 57/55.5; 57/91

[58] Field of Search ..... 57/38.3, 55.5, 91, 107, 57/157 S; 28/71.3, 72.17, 245–246, 243; 242/147 R, 153, 154; 425/76; 264/167, 290 R

[56] References Cited

U.S. PATENT DOCUMENTS

| | | | |
|---|---|---|---|
| 1,187,912 | 6/1916 | Houghton | 242/154 |
| 2,272,666 | 2/1942 | Hoffman | 57/91 X |
| 3,291,417 | 12/1966 | Peters | 242/154 X |
| 3,611,521 | 10/1971 | Corbiere | 28/71.3 |

FOREIGN PATENT DOCUMENTS

| | | | |
|---|---|---|---|
| 2,263,569 | 7/1974 | Germany | 242/154 |

*Primary Examiner*—Richard C. Queisser
*Assistant Examiner*—Charles Gorenstein
*Attorney, Agent, or Firm*—Evelyn M. Sommer

[57] ABSTRACT

An apparatus for manufacturing filaments of varying denier includes electrically activated tension means disposed between a feed roller and a draw roller for engaging the filament and producing a variable tension thereon when activated.

4 Claims, 6 Drawing Figures

APPARATUS FOR MANUFACTURING FILAMENTS OF VARYING DENIER

BACKGROUND OF THE INVENTION

The present invention relates to manufacturing yarn filaments of varying denier and, more particularly, to an apparatus for manufacturing filaments exhibiting random variations in the denier along the length thereof.

Prior art abounds with apparatuses which are designed to draw fibers (filaments) with their primary object being to obtain a product which has a constant denier (fixed diameter) along its entire length. Generally speaking, it has been undesirable to obtain variations in filament denier. These variations cause dye to be absorbed unevenly, thereby causing variations in the final cloth fabricated with this type of yarn filament. Typical examples of prior art directed to the drawing of filaments which attempt to maintain a constant denier are listed below:

| U.S. Pat. No. | Invention Date | Inventor |
|---|---|---|
| 3,978,192 | August 31, 1976 | Sussman |
| 3,780,516 | December 25, 1973 | Kimbrell |
| 3,623,311 | November 30, 1971 | Berger, Jr. |
| 3,622,660 | November 23, 1971 | Ecker, et al. |
| 3,558,767 | January 26, 1971 | Gopez, Jr. |
| 2,289,232 | July 7, 1942 | Babcock |

The above patents describe apparatuses and methods which include the use of heat and/or different mechanical techniques which attempt to maintain a constant denier. However, we are aware of only two patents which attempt to create a variable denier yarn. The first of which is U.S. Pat. No. 3,561,045 issued to Heffernan on Feb. 9, 1971. The Heffernan patent uses a draw roll which is provided with a matte circumferential band and a mirror-finish circumferential band on a cylindrical surface cooperating with a separator roller which has a matte cylindrical surface. A cam is provided between the feed roll and the draw roll to deflect the filament between the two bands in a predetermined manner related to the shape of the cam. Thus, the denier of the filament is varied in a prescribed predetermined manner directly related to the shape of the deflecting cam.

U.S. Pat. No. 3,323,165 to Mottern, et al, issued June 6, 1967, relates to an apparatus providing variable denier yarn. This particular apparatus uses a radiant heat means intermittently applied proximate the filament being drawn at a point between the feed roll and the draw roll. A variation in the denier of the filament or yarn is directly related to the relative position of the radiant heat means to the filament being drawn and is cycled in a prescribed manner. The drawing technique is similar to that shown in the prior art.

A new development in the yarn industry, in recent years, has been the use of flat yarn raw material in the form of a partially oriented yarn. By definition, this means that the yarn has not been fully drawn or oriented. This yarn is completely drawn in a tandem continuous step as described in the prior art. However, as shown in the prior art, since the polymer does not stay in the fully drawn state for more than a few seconds before a new texturized configuration is further imposed upon it, the hydrogen bonds between the molecules have not been established in the fully drawn condition, and the yarn more easily assumes and retains the textured condition. Thus, the use of partially oriented yarns allows faster processing, more effective heat setting, less degradation and improved texture. The use of the partially oriented yarn in carpets requires that they be subjected to very critical quality control standards, since the pile yarn in the carpet is a visible warp yarn. Also, pile height causes a foreshortening of the yarn to the viewer. Using this type of yarn for carpets allows very critical visual comparison of the yarns and very small optical differences are clearly visible as lengthwise streaks in the carpet.

Thus, if we assemble sufficient partially oriented yarns to meet the total carpet denier requirements and then draw and texturize the yarn bundle, very critical quality control would be required to assure that yarns from different manufacturing equipment do not cause streaks in the carpet.

Normally, the undrawn yarn is passed between two sets of yarn gripping rollers, the second set running faster than the first. Thus, the yarn is extended (drawn) by the difference in roller speeds. This technique is known in the prior art and is generally acceptable for manufacturing yarn and filaments for general use. However, this invention relates to manufacturing yarns with varying draw ratios (denier) along the length of the yarn. A number of these yarns will then be assembled, and since each yarn will have different draw ratios along its length and other yarns will have the same variance, but not at exactly the same values, the composite yarn will have a wide spectrum of draw ratios. This will give a differential dye take-up in the polyester element and hence, the composite yarn will dye to a heather mixture of different depths. But more importantly, all yarns produced on different machinery will have a sufficiently wide spectrum so that small variations and draw ratios caused by variances in manufacturing spindles will fall inside the overall spectrum.

The present invention overcomes the shortcomings known in the prior art and discloses a mechanism which is less costly than those known and readily provides yarn with a variable drawn (denier). The present invention utilizes electrically activated means (electromechanical) for providing tension in a random manner for obtaining variable denier yarn filaments. The tension applied to the filament is made proportional to the voltage appearing on the tension applying apparatus. By varying several parameters, a multiplicity of draw ratios can be obtained.

SUMMARY OF THE INVENTION

An object of the present invention is to provide an apparatus for fabricating filaments exhibiting variations in denier along its length.

Another object of the preent invention is to reduce the critical nature of manufacturing variable denier yarns to be used in carpeting.

A further object of the present invention is to provide electrically activated tension means for varying the denier of filaments in a random manner.

Another object of the present invention is to provide economical means for varying the denier of the filaments and enable filaments drawn on different machinery to fall within a given range of draw ratios thus forming a random pile in the finished product which is pleasing to the eye.

An apparatus for fabricating filaments exhibiting variations in the denier along its length, according to the principles of the present invention comprises, means to propel a running filament from a feed roller to a draw roller, electrically activated tension means disposed between the feed roller and the draw roller engaging the filament for producing variable tension thereon.

In order that the invention may be more fully understood it will now be described by way of example with reference to the accompanying drawing.

DESCRIPTION OF THE PREFERRED EMBODIMENT

Figures 1, 6:
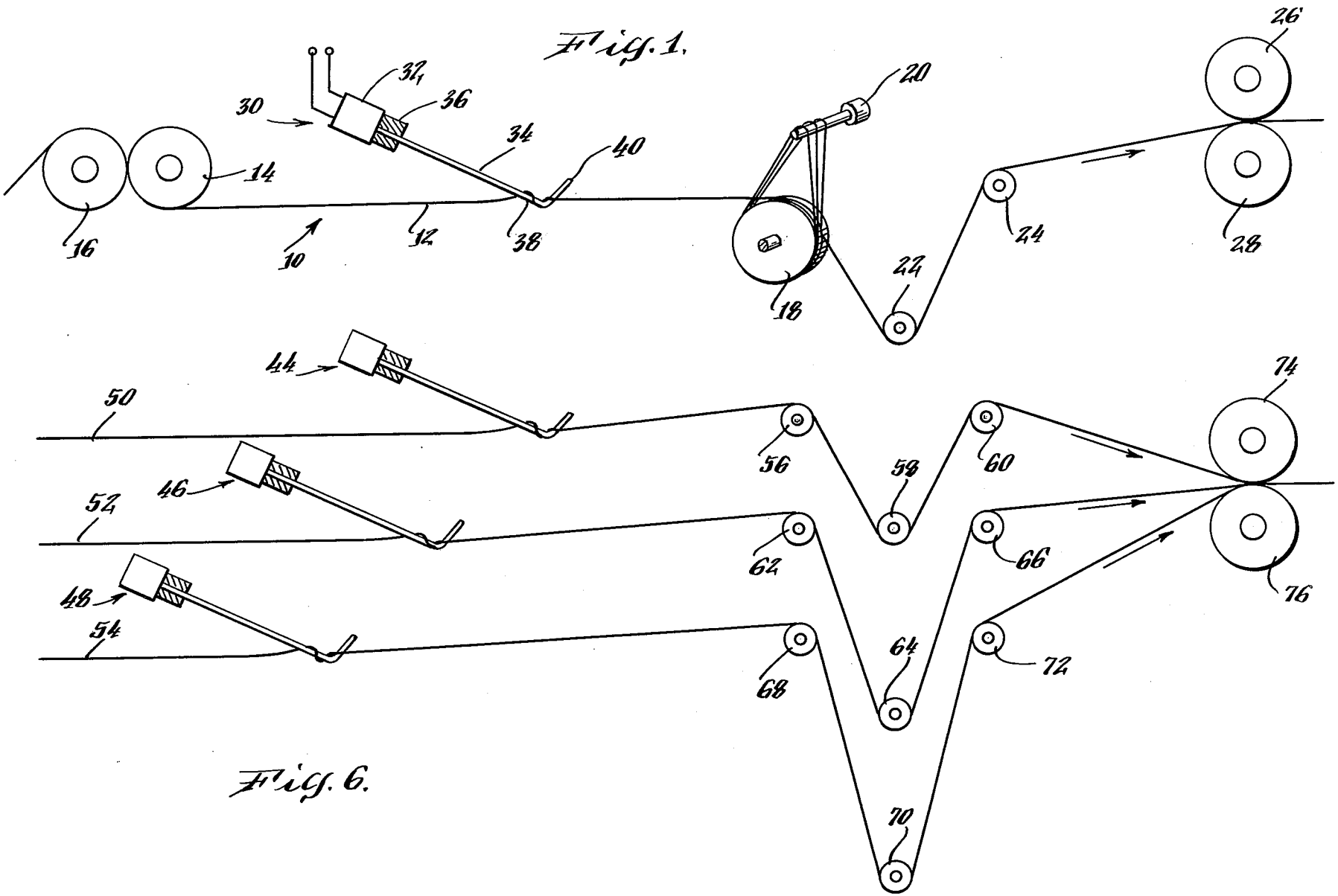
FIG. 1 is a pictorial representation of one portion of an apparatus for manufacturing filaments of varying denier according to the principles of the present invention.
FIG. 6 is a pictorial representation of multiple tension means acting on several filaments.

Now referring to the figures and, more particularly, to FIG. 1, showing a pictorial representation, in simplified form, of a variable denier drawing apparatus 10 having means to propel a running length of filament (yarn) 12. The drawing apparatus 10 includes a feed roller 14 and its associated snubbing roller 16, a draw roller 18 with its cooperating separator roller 20, idler pulleys 22 and 24 guide the filament 12 to a pair of pull rollers 26 and 28, or alternatively, a take-up bobbin, not shown. In the prior art, as discussed before, the stretching of the yarn is normally caused by the draw roller 18 operating at a much higher speed than the feed roller 14 or it may be accomplished by providing the draw roller with a greater diameter and permitting it to operate at a greater speed than that of the feed roller. In the preferred embodiment of the invention there is disposed between the feed roller 14 and the draw roller 18 an electrically activated tension means 30, which may be activated by conventional means not shown, and may include a rotary solenoid or servomechanism motor 32, and an output shaft 34 journaled in a bearing 36 and connected to the armature of the tension means 30. The output shaft 34 is provided at its distal end 38 with an angular portion 40. The angular portion 40 is disposed in close proximity with the filament or yarn 12. Preferably, in the off or inactivated position the rotary solenoid 32 is not in contact with the filament. However, on activation or energization of the rotary solenoid 32, the shaft 34 is caused to rotate causing the angular portion 40 of shaft 34 to come into contact with the filament 12. Thus, rotation of the output shaft 34 causes the filament 12 to become entwined on the shaft, thereby varying the tension of the filament 12.

Figure 2:
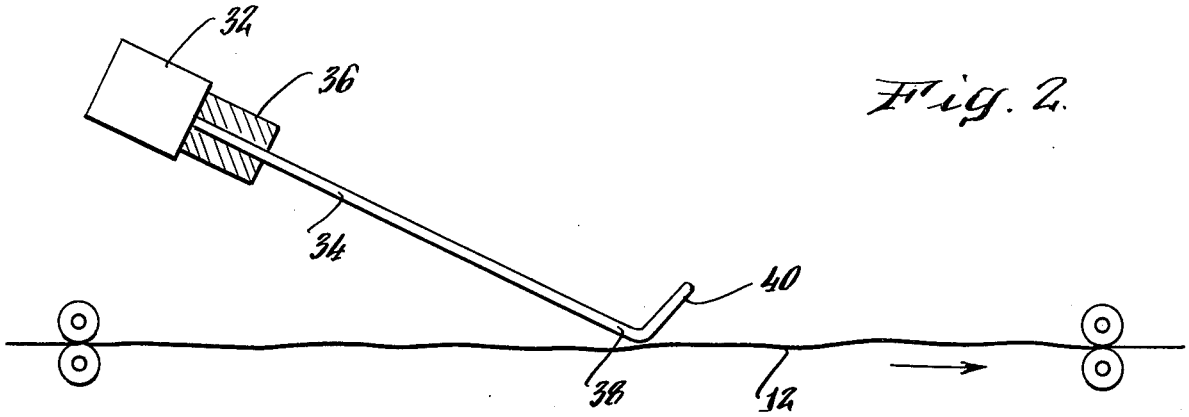
FIG. 2 is a partially enlarged pictorial representation of an electrically activated tension means disposed proximate the filament to be placed under tension.

FIG. 2 is a partially pictorial view of the rotary solenoid 32 showing the outward shaft 34 turning the bearing 36 attached to the armature of the solenoid 32. The distal end of output shaft 34 is in close proximity to filament 12 in the deenergized or deactivated condition of solenoid 32 and thus does not add any tension to the filament 12 in this position. Therefore, the drawing of the filament with a deenergized solenoid is directly related to the speed ratio of the feed roller 14 and the draw roller 18.

Figure 3:
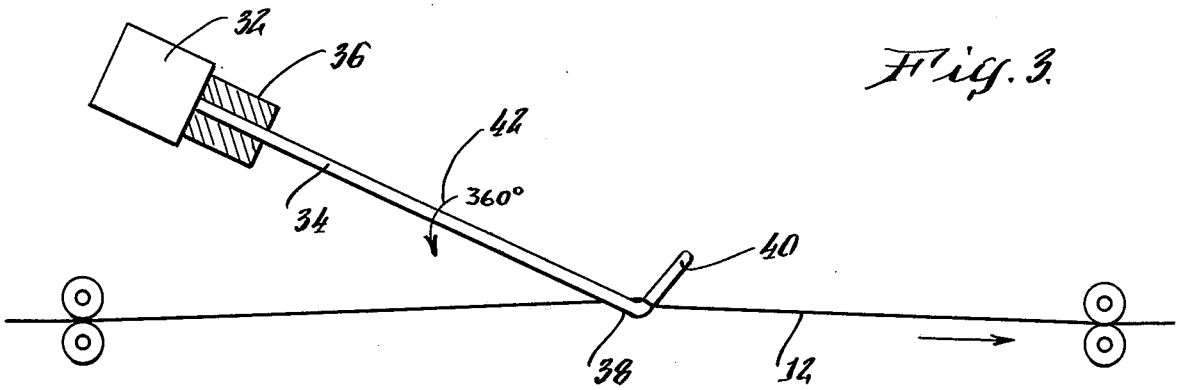
FIG. 3 illustrates the engagement of the electrically activated means with the filament.

FIG. 3 shows the same device as FIG. 2 with the exception that the output shaft 34 has been rotated 360° in the direction of arrow 42. It is to be noted that filament 12 has now been captured or entwined by the angular portion 40 of the output shaft 34 thus placing some tension on the filament 12.

Figure 4:
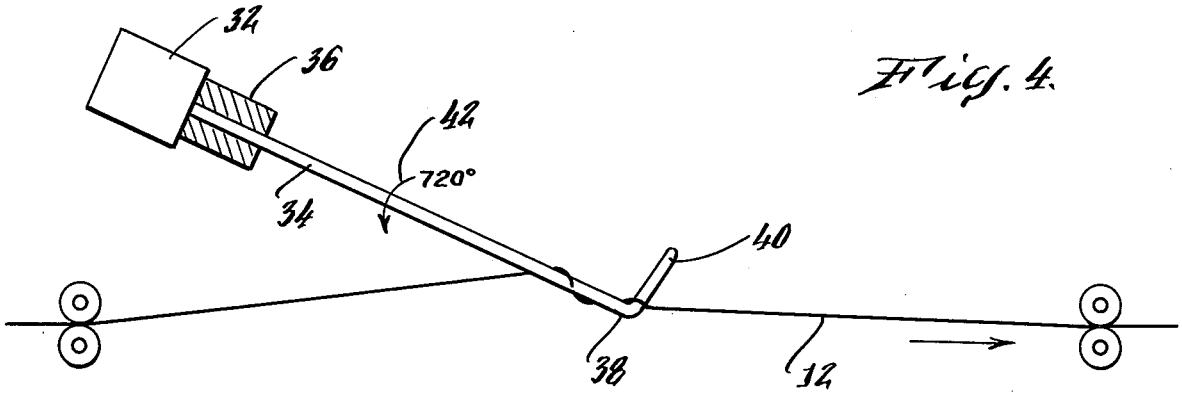
FIG. 4 shows further activation of the electrically activated means whereby the filament has been entwined about the shaft.

FIG. 4 shows the same mechanism as FIGS. 2 and 3 with the addition of another 360° rotation of the output shaft 34. Note the position of filament 12 as it is entwined on shaft 34.

Figure 5:
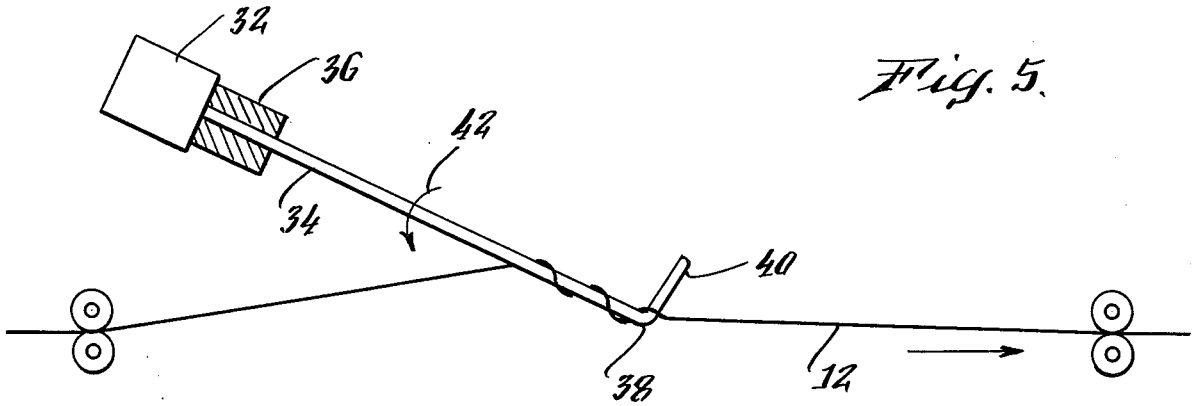
FIG. 5 shows further entwinement of the filament about the shaft.

FIG. 5 shows the tension means 30 with an additional 360° rotation of the output shaft 34. Thus, it can be seen that the filament 12 now encircles the output shaft 34 three times.

It can be shown that the tension on the filament 12 leaving the rod will be equal to:

$$T_{out} = T_{in} \times e^{\mu\theta}$$

Where $T_{out}$ is the final tension on the filament 12 as it leaves the output shaft 34;

$T_{in}$ is the tension on the filament 12 as it approaches shaft 34;

$e$ is the Naperian logarithm;

$\mu$ is the coefficient of friction; and $\theta$ is the angle of wrap of twine around the shaft 34 in radians.

Thus, for example, if the initial tension was increased by one turn or $2\pi$, we would have;

$$e = 2.72$$

$$\mu = 0.1$$

$$360° = 2\pi = 6.78 \text{ radians;}$$

Therefore, the increase in tension ratio would be $$2.72^{0.628} = 1.8746$$

It can be seen that from the change in the position of the filament 12 in FIG. 3 to the position of the filament 12 in FIG. 4, there has been an increase in tension of approximately 1.9. If the initial tension on the filament 12 is measured as 10 grams going into shaft 34, then the exit tension would be the value of $T_{out}$ (exit tension) and is approximately 18.7 grams for FIG. 4 and 35.1 grams for FIG. 5. Thus, by rotating the metal rod 34 between the position shown in FIG. 3 and that shown at FIG. 5 the tension on the filament 12 will change from 10 grams to 35 grams.

Referring now to FIG. 6 which is a pictorial representation of a plurality of tension means 44, 46, and 48 each being similar to the tension means 30. Solenoids 44, 46, and 48, are positioned to cooperate with filaments 50, 52 and 54, respectively and are positioned at different distances from the free running pulleys or guide rollers 56, 58 and 60; 62, 64 and 66; 70 and 72; respectively, before entering the stuffer box pull rolls 74 and 76.

In operation, the tension solenoids 44, 46 and 48 are activated by conventional means to cause the same number of degrees of rotation of their associated output shafts. This causes an equal change in tension on the filaments 50, 52 and 54. However, an increase in tension causes an extension or drawing of the filaments 52, 54 and 56. The filament 54 can expand a greater amount because it has a greater length exposed to tension. Thus, for equal tension changes at the tension rods (during a select interval of time) the draw effect at the stuffer box draw rolls 74 and 76 will not be the same for each filament. The effect of tension changes on the draw ratio of filament 54 will be less than on filament 52, which in turn is less than the draw ratio on filament 50, because of the attenuation of the effect caused by the greater yarn filament length of filament 54.

Hereinbefore has been disclosed an electrically actuated tension means which is disposed between a feed roller and a draw roller and is adapted to apply variable tension on yarn filaments for generating variable denier along its length.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention, what is claimed is:

1. An apparatus for fabricating filaments exhibiting variations in denier along its length comprising:

a. means to propel a running length of filament from a feed roller to a draw roller, and b. electrically activated tension means disposed between said feed roller and said draw roller engaging said filament for providing variable tension thereon, said electrically activated tension means comprising electrically rotatable means having an output shaft coupled thereon, said output shaft being provided with engaging means for engaging said filament and slidably capturing said filament for entwinement on said output shaft.

2. An apparatus according to claim 1 wherein said electrically rotatable means is a rotary solenoid.

3. An apparatus according to claim 1 wherein said electrically rotatable means is a servo motor.

4. An apparatus according to claim 2 wherein said engaging means comprises an angular portion provided on the distal end of said output shaft.

* * * * *